US011285627B2

(12) United States Patent
Veenstra et al.

(10) Patent No.: US 11,285,627 B2
(45) Date of Patent: Mar. 29, 2022

(54) SHAVING UNIT AND SHAVING APPLIANCE

(71) Applicant: KONINKLIJKE PHILIPS N.V., Eindhoven (NL)

(72) Inventors: Geert Veenstra, Boornbergum (NL); Harmen Kooiker, Groningen (NL); Fokke Roelof Voorhorst, Drachten (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 17/050,554

(22) PCT Filed: Apr. 24, 2019

(86) PCT No.: PCT/EP2019/060417
§ 371 (c)(1),
(2) Date: Oct. 26, 2020

(87) PCT Pub. No.: WO2019/211128
PCT Pub. Date: Nov. 7, 2019

(65) Prior Publication Data

US 2021/0252724 A1 Aug. 19, 2021

(30) Foreign Application Priority Data

May 1, 2018 (EP) ..... 18170260

(51) Int. Cl.
*B26B 19/14* (2006.01)

(52) U.S. Cl.
CPC ..... *B26B 19/141* (2013.01); *B26B 19/143* (2013.01)

(58) Field of Classification Search
CPC ..... B26B 19/14; B26B 19/141; B26B 19/143; B26B 19/3846; B26B 19/146; B26B 19/3893; B26B 19/145
(Continued)

(56) References Cited

U.S. PATENT DOCUMENTS 3,116,551 A * 1/1964 Anton ..... B26B 19/143 30/43.6
3,281,937 A 11/1966 Gerrit
(Continued)

FOREIGN PATENT DOCUMENTS

CN 2871138 2/2007
CN 201427317 3/2010
(Continued)

OTHER PUBLICATIONS

International Search Report and Written Opinion dated Jul. 9, 2019 for International Application No. PCT/EP2019/060417 Filed Apr. 24, 2019.

*Primary Examiner* — Ghassem Alie

(57) ABSTRACT

A shaving appliance and a shaving unit are described. The shaving unit has a rotary cutter having a plurality of cutter blades that are provided with a cutting edge. The shaving track includes hair-entry slots that, seen in the direction of movement, have a frontal edge and a rear edge. A slot angle (α) defined as an angle of inclination between the frontal edges (48, 148) of the hair-entry slots. A shearing angle (δ), defined as a difference between the slot angle (α) and an angle of inclination (β) of cutting edges of cutter blades with respect to the radial direction. The shearing angle (δ) is defined at an actual point where the frontal edges and the cutting edges cooperate.

17 Claims, 5 Drawing Sheets

(58) Field of Classification Search
USPC ..... 30/43.4–43.6, 346.51; D28/50
See application file for complete search history.

(56) References Cited

U.S. PATENT DOCUMENTS

| | | | | |
|---|---|---|---|---|
| 3,889,372 | A | 6/1975 | Sakai | |
| 9,789,616 | B2 * | 10/2017 | Mimura | B26B 19/141 |
| 10,471,612 | B2 * | 11/2019 | Shimizu | B26B 19/3893 |
| 2009/0025228 | A1 * | 1/2009 | Minkes | B26B 19/141<br>30/43.6 |
| 2014/0352153 | A1 * | 12/2014 | Zuider | B26B 19/143<br>30/43.6 |
| 2015/0040403 | A1 * | 2/2015 | Campbell | B26B 19/3846<br>30/43.6 |

FOREIGN PATENT DOCUMENTS

| | | |
|---|---|---|
| EP | 1690655 | 8/2006 |
| WO | 2013/093718 | 6/2013 |
| WO | 2013/104965 | 7/2013 |

* cited by examiner

SHAVING UNIT AND SHAVING APPLIANCE

CROSS REFERENCE TO RELATED APPLICATIONS

This application is the U.S. National Phase application under 35 U.S.C. § 371 of International Application No. PCT/EP2019/060417 filed Apr. 24, 2019, which claims the benefit of European Patent Application Number 18170260.6 filed May 1, 2018. These applications are hereby incorporated by reference herein.

FIELD OF THE INVENTION

The present disclosure relates to a shaving unit and to a shaving appliance that is equipped with such a shaving unit. More generally, the present disclosure relates to the field of personal care appliances, grooming appliances and hair cutting appliances. In major embodiments, the present disclosure relates to shaving appliances that are equipped with at least one shaving unit involving a rotary cutter and a guard cap, wherein the rotary cutter is arranged to be rotated with respect to the guard cap. The guard cap covers the rotary cutter. In the guard cap, several slots are provided, for instance along a circular path, also referred to as shaving track. The slots may be referred to as hair-entry slots. The guard cap is made from thin sheet metal material, for instance. At the hair-entry slots, cutting edges are provided that are arranged to cooperate with corresponding cutting edges of the rotary cutter.

In some embodiments, a respective shaving appliance may be equipped with two, three or even more shaving units. Further, to provide for a contour following feature, the shaving units may be mounted in a somewhat pivotable or evasive fashion so that overall the shaving unit may be closely aligned with and contact the user's skin.

BACKGROUND OF THE INVENTION

WO 2013/104965 A1 discloses a shaving unit comprising a rotary cutter having a plurality of cutter blades, each having a cutting edge, the rotary cutter being arranged to rotate about an axis in a direction of movement, a cap having an annular shaving track arranged concentrically about the axis for cooperation with the cutter blades, the shaving track being provided with hair-entry apertures or slots that, seen in the direction of movement, have a frontal edge and a rear edge.

The frontal edges of the hair-entry apertures and the cutting edges of the cutter blades each have a V-shaped portion comprising a central base part interconnecting two associated leg parts mutually enclosing an angle, wherein, in the direction of movement, each central base part of the V-shaped portions of the frontal edges is arranged in front of its associated leg parts, so that the V-shaped portions of the frontal edges point in the direction of movement, and wherein, in the direction of movement, each central base part of the V-shaped portions of the cutting edges is arranged behind its associated leg parts, so that the V-shaped portions of the cutting edges point in a direction opposite to the direction of movement.

In other words, the hair-entry apertures and the cutter blades have a somewhat opposite boomerang-shaped form. In this way, hairs that entered the hair-entry apertures may be gradually pushed towards the tips of the opposite V-shaped forms for being cut there between the cutting edges of the hair-entry apertures of the cap and the cutter blade. Hence, hair cutting primarily takes place in the vicinity of the central tips of the V-shaped elements.

U.S. Pat. No. 3,889,372 discloses a shaving unit having an outer blade fixed to a shaver body and an inner blade which is rotatable relative to the outer blade. The outer blade has a plurality of hair-entry slits each having a cutting edge with a main extension in a radial direction relative to an axis of rotation of the inner blade. The inner blade has a plurality of cutting edges each having a main extension in the radial direction. The inner blade and the hair-entry slits in the outer blade are so arranged that a shearing angle enclosed by the cutting edges of the slits and the cutting edges of the inner blade is constant in any position on the cutting edges. The shearing angle is within a range of 10° to 30°. In a first embodiment, the cutting edges of the inner blade are straight and each extend in the radial direction, while the cutting edges of the slits are curved. In a second embodiment, the cutting edges of the slits are straight and each extend in the radial direction, while the cutting edges of the inner blade are curved.

SUMMARY OF THE INVENTION

A general design goal for shaving units is to improve shaving performance and to reduce skin injuries, such as skin irritations, redness, skin domes or bulges, etc. Further, the hair removal capacity is a relevant key issue in the design and performance of shaving units.

Hence, it is an object of the present disclosure to provide for improvements in the design of shaving units which address at least some of the above-mentioned issues. More particularly, it is desirable to present a shaving unit that is skin-friendly, robust, and also provides for a sufficient cutting performance. It is also desirable to arrive at an even further improved cutting smoothness.

Further, it is desirable to present a shaving unit having a certain operation width (i.e. effective cutting width of the annular path) that is arranged in such a way that a major portion of the width is also used for the cutting action.

Hence, it is also desirable to present a shaving unit that is arranged in such a way that hair manipulating prior to hair cutting is reduced by providing the capacity to cut hair basically along the entire (radial) extension of the involved cutting edges.

Further, it is desirable to present a shaving unit that is long-lasting and wear-resistant, and that maintains a certain level of sharpness and accuracy over the operational life span.

In accordance with a first aspect of the present disclosure there is presented a shaving unit comprising:

a rotary cutter comprising a plurality of cutter blades that are provided with a cutting edge, the rotary cutter being arranged to rotate about a rotation axis in a direction of movement; and a guard cap comprising an annular shaving track surrounding the rotation axis for cooperation with the cutter blades, the shaving track being provided with hair-entry slots that, seen in the direction of movement, have a frontal edge and a rear edge;

wherein the frontal edges of the hair-entry slots are, in a cutting portion along the long side extension of the hair-entry slots, inclined with respect to a radial direction relative to the rotation axis, wherein a slot angle $\alpha$ defined as an angle of inclination of the frontal edges of the hair-entry slots with respect to the radial direction is in a range from 35° to 60°;

wherein a shearing angle δ, defined as a difference between the slot angle α and an angle of inclination β of the cutting edges of the cutter blades with respect to the radial direction, is in a range from +20° to −20°; and wherein the shearing angle δ is defined at an actual point where the frontal edges and the cutting edges cooperate.

The above aspect is based on the insight that setting the slot angle α of the hair-entry slots to a certain rather large value has a positive effect on hair cutting since the likelihood of hairs being simply pushed away towards a limited cutting zone is reduced. In certain embodiments, but not to be understood in a limiting sense, providing cutter blades having similar cutting angles may also contribute thereto. In certain embodiments, but not to be understood in a limiting sense, the cutting angle (referred to herein as angle of inclination β) of the cutter blade (i.e. angle between cutting edge of the cutter blade and radial direction) is basically similar to the slot angle α of the guard cap (i.e. angle between cutting edge of the slot at the guard cap and radial direction). This relation is represented by the shearing angle δ that is relatively small.

As used herein, a positive shearing angle δ means that an angle of inclination β of the cutting edge of the cutter blades with respect to the radial direction is greater than the slot angle α. A negative shearing angle δ means that the angle of inclination β is smaller than the slot angle α.

In other words, in accordance with the above aspect, the rotary cutter and the guard cap may be designed in such a way that basically the full length (radial extension) of the cutting edges of the two parts takes an active part in the hair cutting process.

A further benefit is that there is less hair manipulation which contributes to an overall improvement of the user's comfort. This contributes to an overall improvement of the user's comfort. Since a greater portion of the radial extension of the cutting edges is involved in the cutting operation, the overall wear and the gradation of the cutting edges of both the cutter and the guard cap may be reduced. Overall, the operational life span may be increased.

Further, due to the relatively large inclination angle α between the involved edges of the hair-entry slots and the radial direction, skin doming, skin bulging and similar adverse events increasing the likelihood of skin irritations may be reduced or even avoided. It has been observed that the somewhat inclined overall orientation of the hair-entry slots, as opposed to a strict radial orientation, avoid cutting and clamping of skin in the slots which would cause discomfort.

Further, the inclined orientation of the hair-entry slots avoid what may be referred to as parallel doming, caused by a huge number of radial slots arranged close to one another.

A further advantage is that in accordance with at least some embodiments, thinner cutting blades may be used. Hence, shaving smoothness can be improved.

In accordance with an exemplary embodiment of the shaving unit, the slot angle α is in a range from 35° to 45°.

It has been observed that, as a general rule, the greater the inclination angle is the better the skin friendliness will be. It should be noted that of course in practice there may be other factors of influence that may be an argument against making the inclination angle too large. Anyway, it has been observed in some embodiments that even an inclination angle (slot angle) of greater than 60° is, in terms of user comfort, a viable option that is superior to alternative embodiments having significantly smaller inclination angles.

Skin friendliness may be assessed based on the likelihood and severity of skin burning, redness, etc. As used herein, the slot angle α and the angle of inclination β are acute angles, and not their counterpart obtuse angles formed between the respective edges and the radial direction.

In accordance with another exemplary embodiment, the shearing angle δ is in a range from +15° to −15°, preferably in a range from +10° to −10°.

Keeping the shearing angle δ relatively small results in an improved performance as the hairs are not gradually pushed into a rather limited cutting zone, which would involve a certain amount of hair manipulating, but directly processed/cut, due to the cooperation between the cutter and the guard cap. This applies for both positive and negative (small) shearing angles δ. The inclination of the cutting edges of the cutter blades with respect to the radial direction is similar to the inclination of the frontal edges of the hair-entry slots with respect to the radial direction. The frontal edges of the hair-entry slots may be referred to as cutting edges.

As used herein, a radial direction is defined between a center/main axis of the shaving unit and a point of intersection between a radial ray and the involved edge/geometry. Further, when two elements/two cutting edges are involved, the radial direction is defined between the center of the shaving unit and a point of intersection between the edges at the rotary cutter and the guard cap.

In accordance with another exemplary embodiment, the angle of inclination β of the cutting edges of the cutter blades with respect to the radial direction is greater than 40°. Hence, also the cutting edges of the cutter have a certain inclination with respect to the radial direction, whereas, however, often a relatively small angular offset between the cutting edges of the cutter and the frontal edge of the hair-entry slots is present. The cutting edges of the cutter and the frontal edge of the hair-entry slots are generally not parallel, but may be parallel in certain embodiments. The angle of inclination β is composed of the slot angle α and the shearing angle δ.

In accordance with another exemplary embodiment, the hair-entry slots have a basically straight main extension. This may involve, in certain embodiments, also slightly curved shapes of the hair-entry slots. When a curved shape of the hair-entry slots and also of the respective edges is present, the above angular ranges and values may be determined based on a mean slope and/or a respective tangent line.

In accordance with another exemplary embodiment, the cutter blades have a basically straight main extension. This may involve, in certain embodiments, also slightly curved shapes of the hair-entry slots. When a curved shape of the cutter blades and also of the respective cutting edges is present, the above angular ranges and values may be determined based on a mean slope and/or an imaginary tangent.

In accordance with another exemplary embodiment, the frontal edges of the hair-entry slots are curved in the radial direction relative to the rotation axis. As used herein, the term curved may relate to slightly curved shapes of the hair-entry slots.

In accordance with another exemplary embodiment, wherein the frontal edges of the hair-entry slots are curved in the radial direction relative to the rotation axis, wherein the hair-entry slots and the cutter blades preferably have the same curvature orientation (apex or tip pointing in the same direction).

As used herein, the term curved may relate to slightly curved shapes of the hair-entry slots and/or the cutter blades of the cutter.

In accordance with another exemplary embodiment, the hair-entry slots have a V-shaped main extension. In accordance with another exemplary embodiment, the tips of the V-shaped hair-entry slots are front-oriented, seen in the direction of movement.

In other words, the hair-entry slots may be boomerang-shaped, whereas a tip between the two legs thereof points in the movement/rotation direction. Consequently, the two legs of the V-shape are open towards the rear edge of the hair-entry slots, that is, opposite to the direction of movement.

In accordance with another exemplary embodiment, the cutter blades have a V-shaped main extension. In accordance with another exemplary embodiment, the tips of the V-shaped cutter blades are front-oriented, seen in the direction of movement.

Hence, also the cutter blades may be boomerang-shaped. However, as opposed to the arrangement disclosed in WO 2013/104965 A1, the V-shape defined by the cutter blades is not oriented opposite to the V-shape defined by the hair-entry slots. In other words, a tip between the two legs of the V-shaped cutter blade and the respective cutting edge points forwards, in the movement direction. Put differently, the two legs of the V-shape are open backwards.

It is to be noted in this context that in an embodiment comprising V-shaped forms for the hair-entry slots and/or the cutter blades, a transition (tip area) between the two opposite legs shall not be used to define the slot angle $\alpha$ and/or the shearing angle $\delta$, and the resulting angle of inclination $\beta$.

Hence, the cutters and the hair-entry slots are not opposed to one another to urge the hairs into a decreasing cutting zone close to the respective tips of the V-shape. Rather, is more likely that hairs are cut without being manipulated too much.

In accordance with another exemplary embodiment of the shaving unit, at the hair-entry slots and the cutter blades two cutting portions are present, one of which being defined as a first leg of, respectively, the V-shaped hair-entry slots and the V-shaped cutter blades, and the other one being defined as a second leg of, respectively, the V-shaped hair-entry slots and the V-shaped cutter blades.

Hence, not only one but two cutting portions are present, each of which may be defined and shaped in accordance with at least some aspects of the present disclosure.

In accordance with another exemplary embodiment, the first and the second legs have opposite inclination angles with respect to the radial direction.

The respective inclination angles (with respect to the instantaneous radial direction) of the hair-entry slots and the cutter blades may be the same, or may be different on both legs.

In accordance with another exemplary embodiment, an angle $\varepsilon$, which is enclosed by the cutting edges of the first leg and the second leg of the V-shaped cutter blades, is smaller than an angle $\gamma$ which is enclosed by the frontal edges of the first leg and the second leg of the V-shaped hair-entry slots.

In other words, in accordance with this embodiment, the V-shape characterizing the cutting edge of the cutter blades is more pointed than the V-shape characterizing the hair-entry slots. In other words, the V-shaped cutting edge of the cutter blade is blunter than the V-shaped frontal edge of the hair-entry slot. Generally, the V-shape is aligned with a circumferential direction.

As a result, hairs that entered the hair-entry slot for being cut between the frontal edge thereof and the cutting edge of the cutter blade are not inevitably pushed to the tip.

In accordance with another exemplary embodiment, a shaving head is presented that comprises two or more shaving units in accordance with at least one embodiment as described herein, and further comprises a support member supporting the shaving units.

In certain embodiments, three shaving units that are provided may form a triangle shaving head of the shaving appliance. In other embodiments, two shaving units are provided that are arranged basically adjacent to one another. Respective rotation axes of the shaving units may be parallel, in certain embodiments. However, in alternative embodiments, the rotation axes of the shaving units are slightly inclined with respect to one another to improve the contour-adapting and the contour-following capability of the shaving appliance. Generally, the shaving appliance may be referred to and arranged as a grooming appliance.

In another aspect of the present disclosure, there is presented a shaving appliance comprising a housing, a shaving head in accordance with at least one embodiment as described herein, and a drive unit to cause rotation of the rotary cutters of the shaving units of the shaving head.

Generally, the shaving appliance comprises a housing having a handle portion and a cutting head where the shaving unit is disposed.

The shaving unit comprises at least one shaving unit formed by a cutter blade and a guard blade. The cutter blade may be referred to as rotary cutter. The guard blade may be referred to as guard.

In certain embodiments, the shaving appliance comprises two respective shaving units that are basically parallel or at least slightly inclined to one another. In alternative embodiments, the shaving appliance comprises three respective shaving units that are basically parallel or at least slightly inclined to each other and that are arranged in a triangular fashion at the cutting head of the appliance.

As already indicated further above, the shaving units may be arranged in a somewhat pivotable manner to provide the shaving unit with a certain skin contour following capacity.

Generally, the shaving appliance may be arranged as a rotary shaving appliance having rotary shaving units. This involves a relative rotation between the rotary cutter and the guard cap when the appliance is operated.

The shaving appliance is generally equipped with one or more motors to drive the at least one shaving unit. Further, the shaving appliance may be provided with a battery for power supply. In the alternative, the shaving appliance may be provided with a mains cable for power supply and/or for battery recharging.

BRIEF DESCRIPTION OF THE DRAWINGS

These and other aspects of the invention will be apparent from and elucidated with reference to the embodiments described hereinafter. In the following drawings

DETAILED DESCRIPTION OF THE INVENTION

Figure 1:
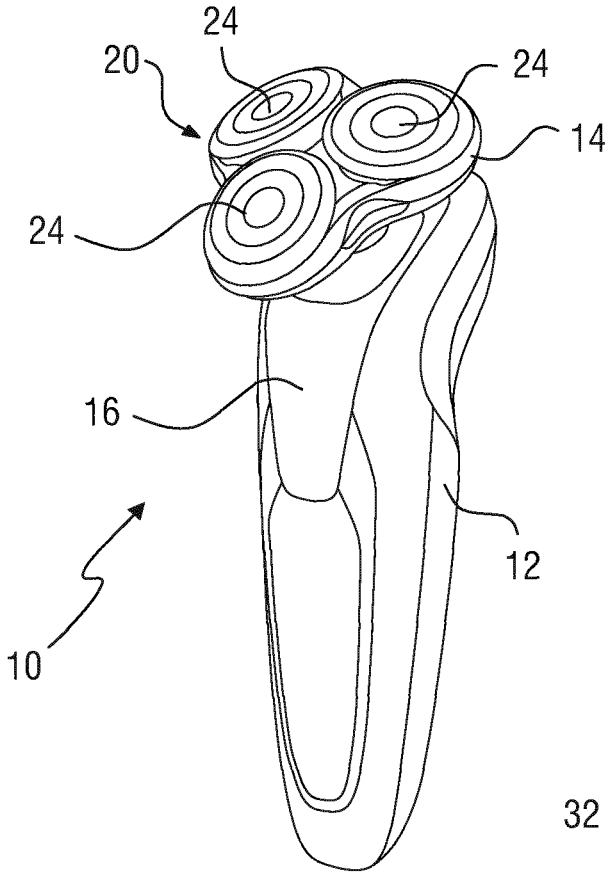
FIG. 1 shows a perspective view of an embodiment of a hair cutting appliance arranged as a shaving appliance.

FIG. 1 shows in a perspective top view a hair cutting appliance 10 that is arranged as a shaving appliance. The appliance 10 comprises an elongated housing 12 and a cutting unit 14, 20 arranged at a top end of the housing 12.

In the housing 12, a drive unit 16 is accommodated (not illustrated herein in much detail). The drive unit 16 is arranged to operate and actuate the cutting unit 14, 20. At the housing 12, there may be provided further components of the appliance 10, such as operator controls, a battery, a socket for an electric cable, and such like.

Figure 2:
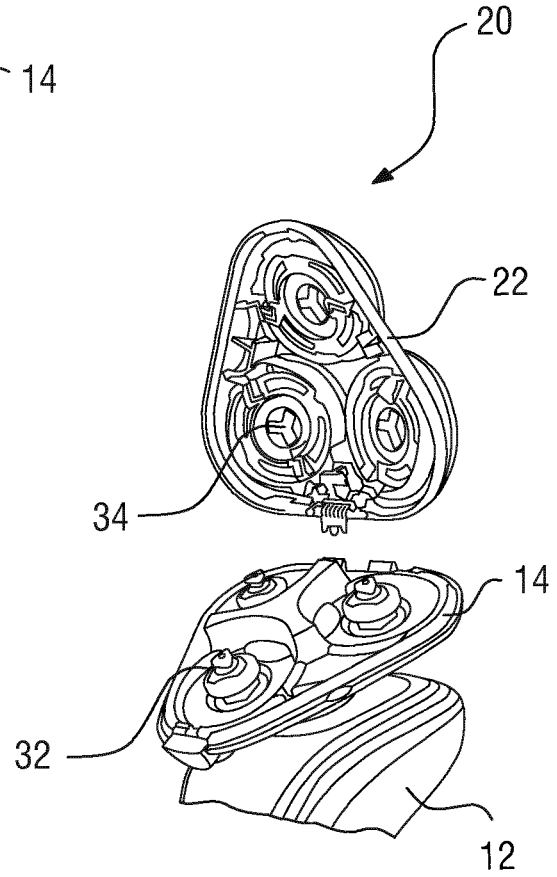
FIG. 2 shows a partial view of the appliance as shown in FIG. 1, wherein a shaving head of a cutting unit is detached.

The cutting unit 14, 20 comprises a shaving head 20 which is releasably provided on a support structure 14 of the cutting unit 14, 20. In FIG. 2, the shaving head 20 is detached and forwarded away from the support structure 14 that is attached to the housing 12. The shaving head 20 comprises at least two shaving units 24 and a support member 22 supporting the shaving units 24.

In accordance with the exemplary embodiment of the appliance 10 illustrated in FIGS. 1 and 2, the shaving unit 20 comprises three shaving units 24 that are arranged in a somewhat triangular fashion.

Figure 3:
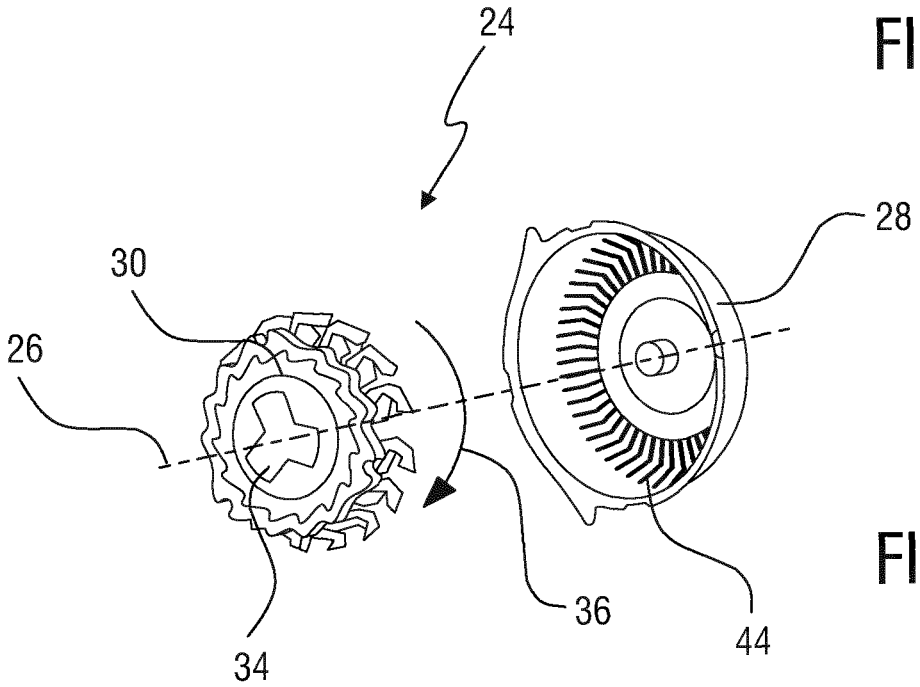
FIG. 3 shows a shaving unit of the appliance as illustrated in FIG. 1 and FIG. 2, the shaving unit comprising a rotary cutter and a guard cap that are shown in a detached state.

FIG. 3 is a perspective exploded view of a shaving unit 24. FIG. 3 illustrates that the shaving units 24 each comprise a guard cap 28 and a rotary cutter 30.

When the appliance 10 is operated for hair shaving procedures, the rotary cutter 30 rotates about a rotation axis 26 with respect to the guard cap 28.

As illustrated in FIG. 1, the shaving units 24 may be somewhat inclined with respect to each other. Further, the shaving units 24 may be at least slightly pivotable about an axis that is not parallel to the rotation axis 26, preferably perpendicular thereto. This allows for a certain contour following capacity of the shaving head 20.

In FIG. 2, respective drivers 32 of the driving unit 16 are indicated, wherein the drivers 32 are arranged to engage respective driving recesses 34 provided at the rotary cutters 30 of the shaving units 24.

A rotation direction of the rotary cutter 30 of each shaving unit 24 with respect to the (stationary and non-rotating) guard cap 28 is indicated by a curved arrow designated by numeral 36 in FIG. 3.

In the guard cap 28 as shown in FIG. 3, an annular shaving track 44 is formed. In the mounted state, cutter blades that are formed at the rotary cutter 30 contact the interior of the guard cap 28 in the region of the annular shaving track 44. A relative rotation between the guard cap 28 and the rotary cutter 30 allows hairs to be cut between the involved cutting edges of the two main components of the shaving unit 24.

Figure 4:
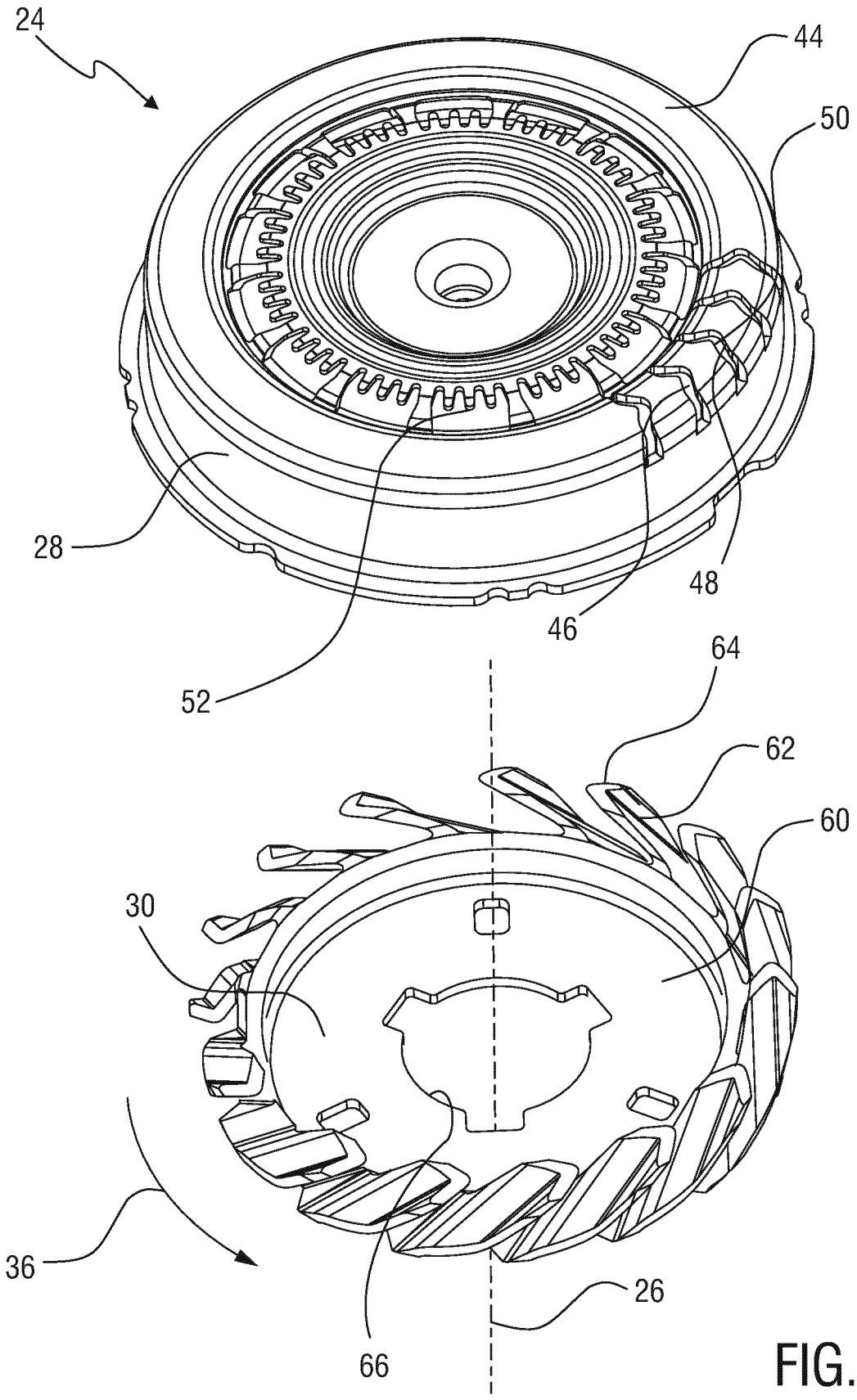
FIG. 4 shows an exploded perspective top view of an exemplary embodiment of a shaving unit in accordance with the present disclosure.

Further reference is made to the perspective exploded top view of FIG. 4, providing an enlarged illustration of a guard cap 28 and a rotary cutter 30 that form a shaving unit 24 in accordance with at least some aspects of the present disclosure.

Figure 5:
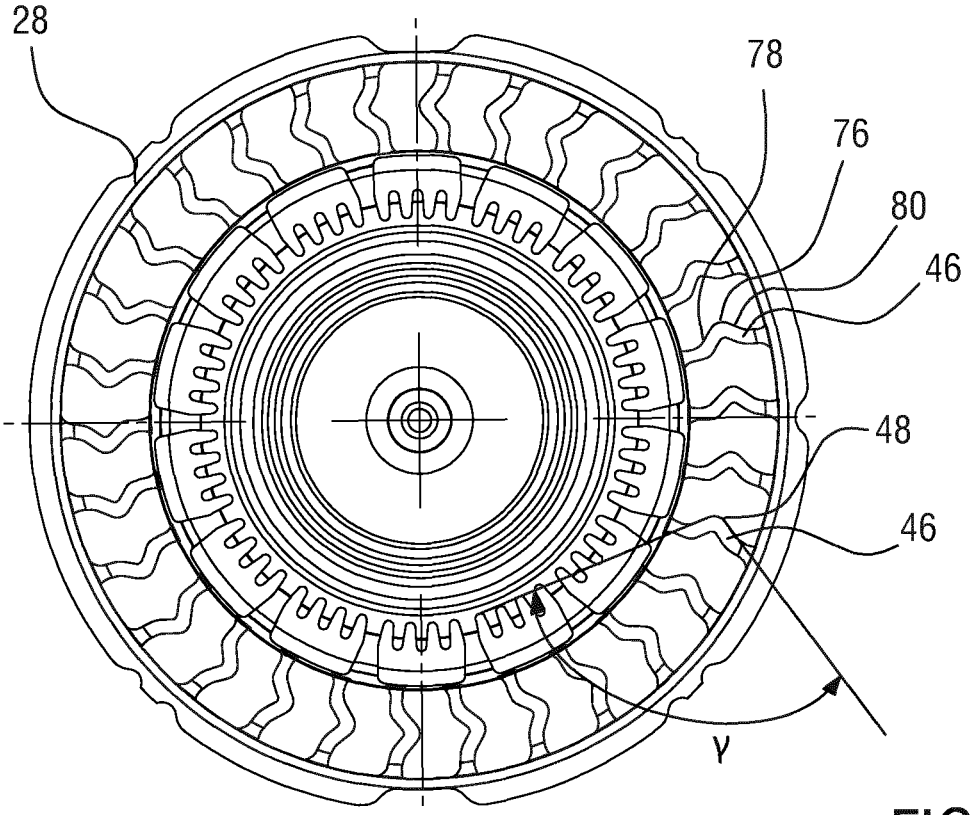
FIG. 5 shows a top view of the guard cap shown in FIG. 4.
Figure 6:
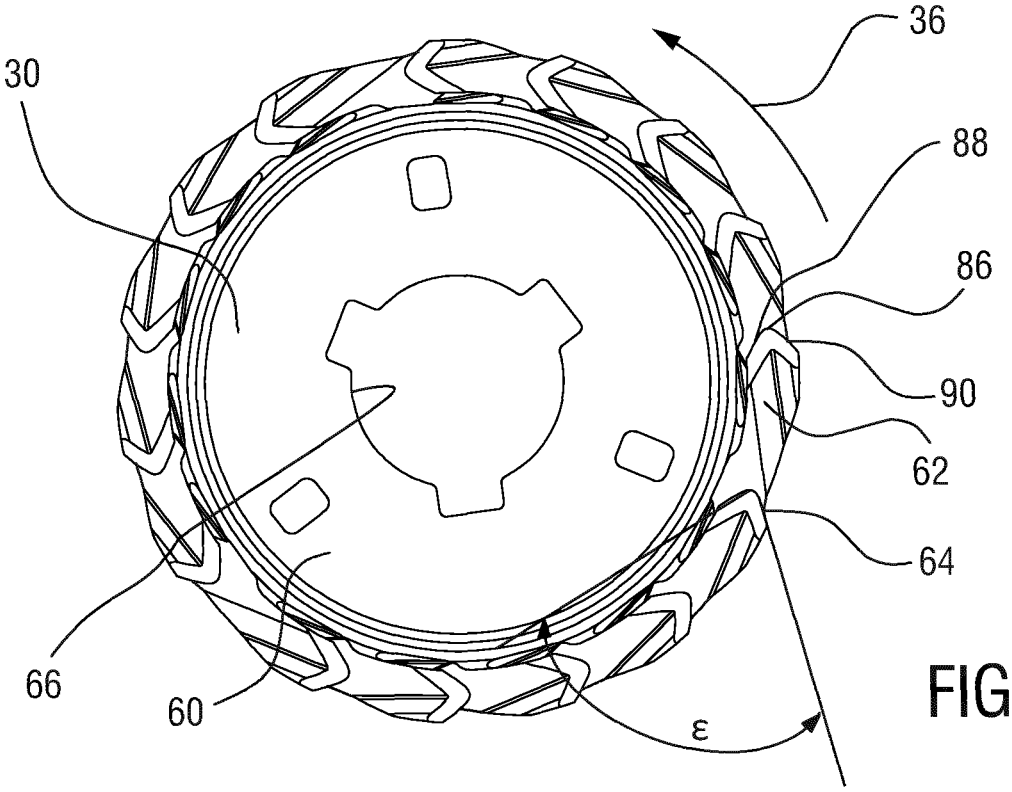
FIG. 6 shows a top view of the rotary cutter shown in FIG. 4.
Figure 7:
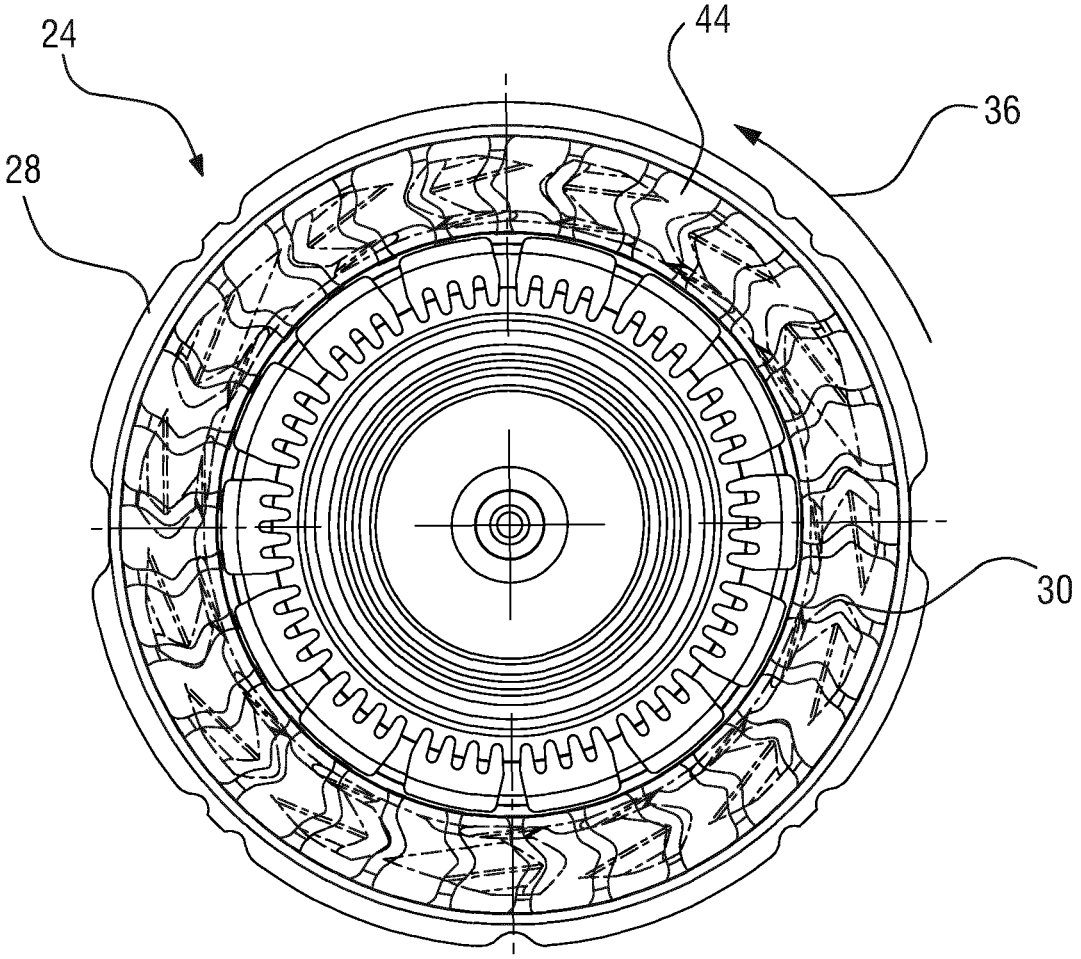
FIG. 7 shows a top view of the shaving unit as shown in FIG. 4, wherein the rotary cutter is indicated by dashed lines.

Additional reference is made to FIG. 5 and FIG. 6, showing top views of the guard cap 28 and the rotary cutter 30, and to FIG. 7, illustrating and assembly state of the guard cap 28 and the rotary cutter 30.

Figure 8:
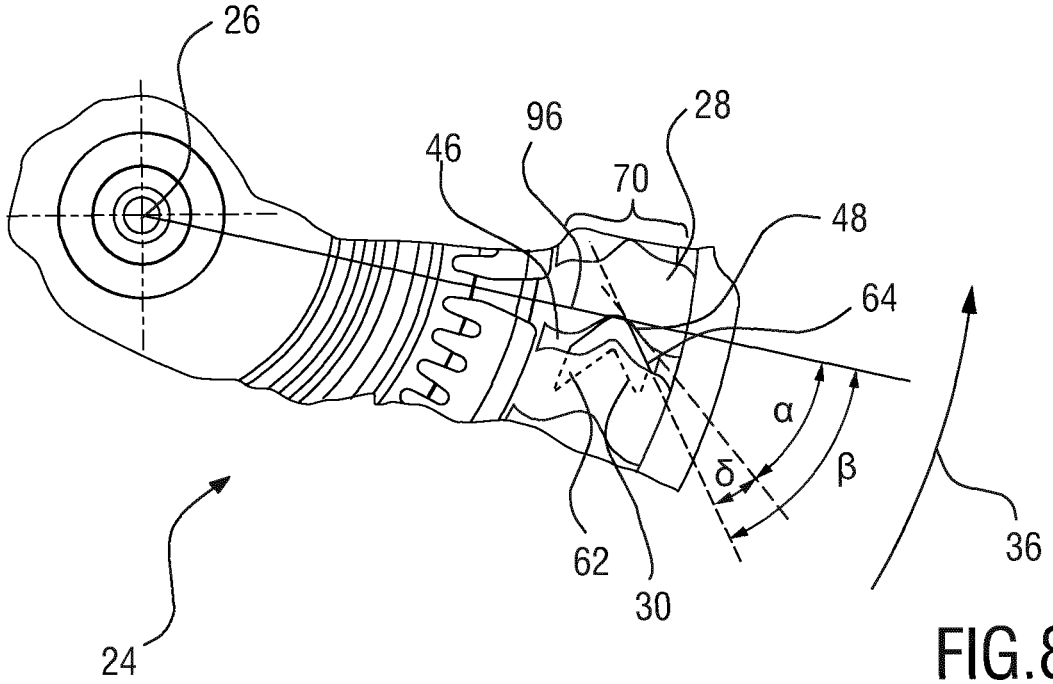
FIG. 8 is a partial enlarged view of the arrangement of FIG. 8, illustrating a cutting zone.

Additional reference is made to FIG. 8, illustrating an enlarged partial top view of the shaving unit 24 to explain the geometry and shape of the hair-entry slots 46 and the cutter blades 62.

In FIG. 4, the rotation axis 26 and the rotation direction 36 are indicated by respective numerals. At the guard cap 28, an annular shaving track 44 is formed at the rear side thereof (covered by the front face of the guard cap 28 in FIG. 4). At the annular shaving track 44, a series of hair-entry slots 46 is formed and circumferentially distributed about the rotation axis 26.

The hair-entry slots 46 each comprise a frontal edge 48 and a rear edge 50, as seen in the direction of movement of the rotary cutter 30 with respect to the guard cap 28. The frontal edge 48 of the hair-entry slots 46 may also be referred to as cutting edge of the guard cap 28.

The hair-entry slots 46 are arranged and spaced apart from one another about a center of the guard cap 28 by constant or non-constant spacing angles (angular offset).

The rotary cutter 30 illustrated in FIG. 4 comprises a base plate 60 and a plurality of cutter blades 62 extending and/or protruding therefrom. The cutter blades 62 are arranged circularly. The cutter blades 62 form a wreath or crown-like arrangement.

At a respective top end of the cutter blades 62 facing the annular shaving track 44, respective cutting edges 64 are formed that cooperate with the frontal edges 48 of the hair-entry slots 46 at the guard cap 28.

The rotary cutter 30 further comprises a driving contour 66 formed at the base plate 60. Via the driving contour 66, the rotary cutter 30 may be activated and rotated by a driving unit (see the arrow 36 indicating the rotation direction) with respect to the guard cap 28.

As can be seen in FIG. 5, the hair-entry slots 46 of the embodiment illustrated in FIGS. 4 to 8 are basically V-shaped or boomerang-shaped.

FIG. 5 shows that the V-shaped hair-entry slots 46 include also respectively shaped frontal edges 48. The frontal edges 48 comprise a tip 76 which may also be referred to as frontal tip, and a first leg 78 and a second leg 80. The tip 76 points in a direction of rotation of the rotary cutter 30. In the exemplary embodiment illustrated in FIG. 5, also the rear edges 50 of the hair-entry slots 46 are V-shaped.

Overall, the V-shaped hair-entry slots 46 are, in terms of their lengthwise extension, arranged to be basically perpendicular to a circumferential direction, and basically aligned with a radial direction. The same applies to the frontal edges 48.

As can be best seen in FIG. 6, also at the cutter blades 62 of the rotary cutter 30, a V-shaped or boomerang-shaped form is provided. The cutting edge 64 comprises a tip 86 and two adjacent legs 88, 90. The tip 86 is arranged between a first leg 88 and a second leg 90. Overall, the V-shaped cutting edges 64 are, in terms of their lengthwise extension, arranged to be perpendicular to a circumferential direction, and basically aligned with a radial direction.

In FIG. 5, an angle between the two legs 78, 80 of the frontal edge 48 is indicated by γ (gamma). Further, as can be seen in FIG. 6, an angle between the two legs 88, 90 of the cutting edge 64 is indicated by ε (epsilon).

In accordance with at least some embodiments of the present disclosure, the angle γ between the two legs 78, 80 of the frontal edge 48 is greater than the angle ε between the two legs 88, 90 of the cutting edge 64. Further, both the frontal edge 48 and the cutting edge 64 point in the same direction (and also in the same direction as the rotation direction 36).

The design of the hair-entry slots 46 and the cutter blades 62 has the effect that hairs are not (primarily) pushed towards the tips of the frontal edges 48, but basically processed/cut along the entire (radial) extension of the frontal edges 48. Hence, the risk of having a large number of hair filaments trapped at the tip 76 is significantly reduced.

FIG. 7 shows an assembled state of the rotary cutter 30 and the guard cap 28, where the cutter blades 62 are arranged in the annular shaving track 44 to cooperate with the hair-entry slots 46. In FIG. 7, the rotary cutter 30 is illustrated by dashed lines and covered by the guard cap 28.

FIG. 8 illustrates further aspects of the design of the rotary cutter 30 and the guard cap 28 in accordance with at least some embodiments of the present disclosure. In FIG. 8, a partial top view of the guard cap 28 and the rotary cutter 30 is provided, wherein the rotary cutter 30 is represented by a simplified illustration of a top face of a cutter blade 62 facing the annular shaving track 44 (refer to FIG. 7), wherein hidden lines of the cutter blade 62 are illustrated by dashed lines.

In FIG. 8, a radial direction departing from the (central) rotation axis 26 is indicated by 96. For definition purposes, the ray 96 defining the radial direction intersects with a (temporary) point of intersection between the frontal edge 48 and the cutting edge 64.

Reference numeral 70 indicates a cutting portion along a long side extension of the frontal edges 48 of the hair-entry slots 46. The cutting portion 70 is an area where the hair-entry slot 46 and the cutter blade 62 contact one another and cooperate to cut hair therebetween.

The frontal edge 48, at least one leg or portion thereof, is arranged at an angle α (alpha) with respect to the radial direction 96. The cutting edge 64, at at least one leg or portion thereof, is arranged at an angle β (beta) with respect to the radial direction 96. The angle α may also be referred to as slot angle. The angle β may also be referred to as inclination angle of the cutting edge 64.

It is apparent from FIG. 8 that the angle β is greater than the angle α. An angle difference between the angles α and β is indicated by an angle δ (delta) which may also be referred to as shearing angle. As indicated further above, the slot angle α is in a range of between 35° and 60° (degrees). Preferably the slot angle α is in a range of between 35° and 45°.

Preferably, the inclination angle β is selected in such a way that the shearing angle δ is less than +/−20°. In some embodiments, the shearing angle δ is less than +/−10°. In some embodiments, the shearing angle δ is less than +/−5°.

In certain embodiments, the angle γ between the two legs 78, 80 of the frontal edge 48 is smaller than 120°. In alternative embodiments, the angle γ between the two legs 78, 80 of the frontal edge 48 is smaller than 105°. In alternative embodiments, the angle γ between the two legs 78, 80 of the frontal edge 48 is smaller than 90°.

In certain embodiments, the angle ε between the two legs 88, 90 of the cutting edge 64 is a maximum of 60° but more than 0° smaller than the angle γ. In certain embodiments, the angle ε between the two legs 88, 90 of the cutting edge 64 is a maximum of 30° but more than 0° smaller than the angle γ.

In certain embodiments, the angle ε between the two legs 88, 90 of the cutting edge 64 is a maximum of 20° but more than 0° smaller than the angle γ. In certain embodiments, the angle ε between the two legs 88, 90 of the cutting edge 64 is a maximum of 10° but more than 0° smaller than the angle γ.

Figure 10:
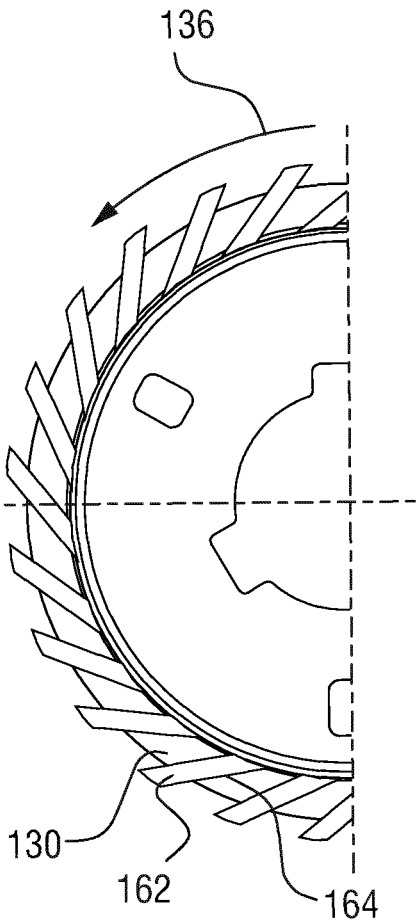
FIG. 10 is a half top view of a rotary cutter arranged to cooperate with the guard cap of FIG. 9.
Figure 9:
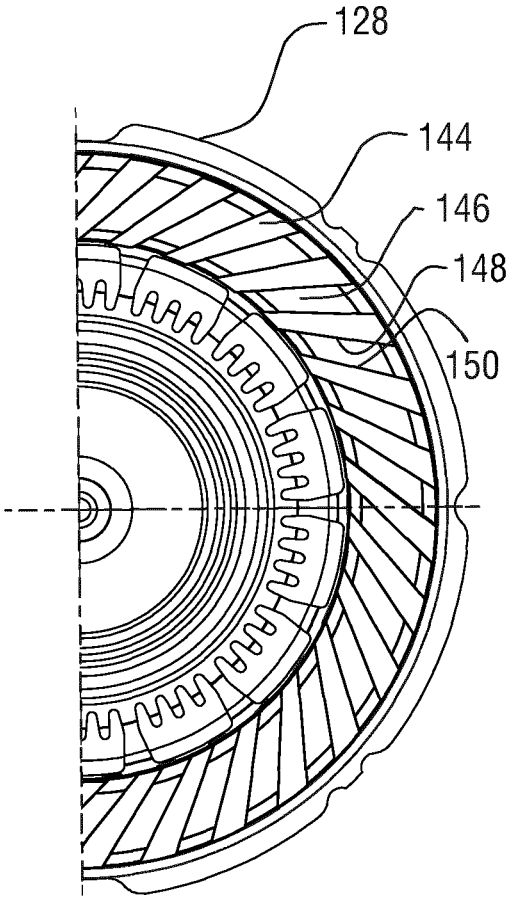
FIG. 9 is a half top view of a guard cap of a shaving unit in accordance with another exemplary embodiment in accordance with the present disclosure
Figure 11:
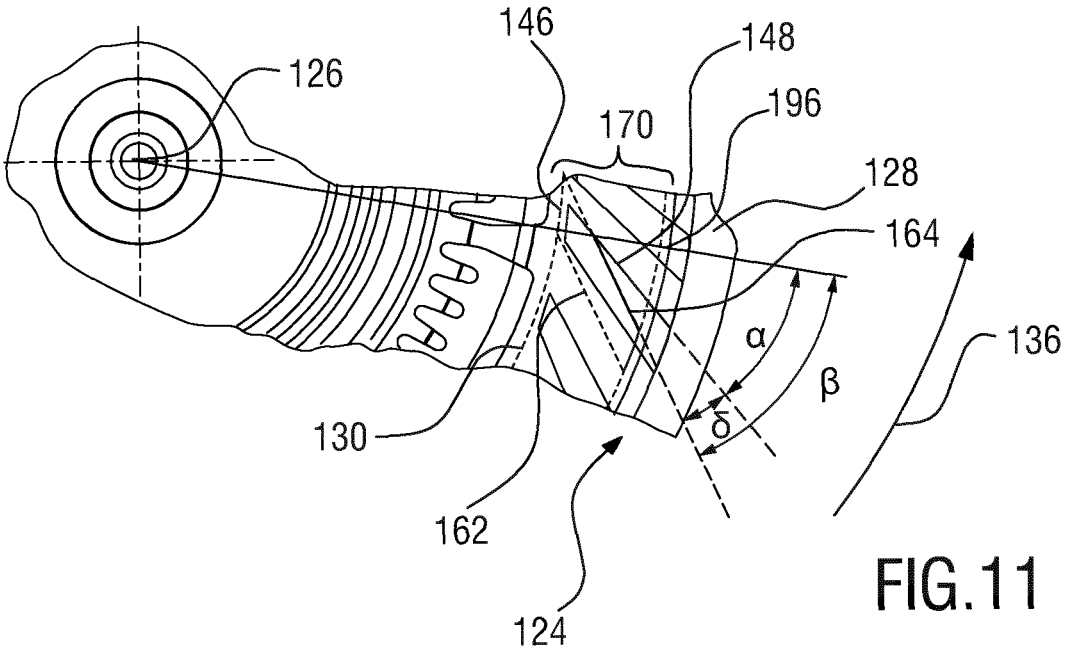
FIG. 11 is a partial enlarged view of an assembly of the guard cap of FIG. 9 and the rotary cutter of FIG. 10, illustrating a cutting zone.

With reference to FIG. 9, FIG. 10 and FIG. 11, an alternative embodiment in accordance with the present disclosure is explained. FIG. 9 is top half view representation of a guard cap 128. FIG. 10 is a corresponding top half view representation of a rotary cutter 130.

The guard cap 128 is provided with an annular shaving track 144 comprising a series of circumferentially arranged hair-entry slots 146. The hair-entry slots 146 comprises a frontal edge 148 and an opposite rear edge 150. In a direction of movement of the rotary cutter 130 (refer to the curved arrow 136 in FIG. 10), the frontal edge 148 is in front of (downstream of) the rear edge 150.

The hair-entry slots 146 include a basically linear shape, as opposed to the V-shaped or boomerang-shaped hair-entry slots 46 of the embodiment as described in FIGS. 4 two 8. However, a main extension direction of the hair-entry slots 146 and/or the main extension of the frontal edge 148 is/are somewhat inclined with respect to a respective radial direction (which will be discussed further below in connection with FIG. 11).

At the rotary cutter 130 that is shown in FIG. 10, a circular series of cutter blades 162 that are provided with cutting edges 164 is formed. Also the cutter blades 162 and/or their cutting edges 164 are basically linearly shaped but at least slightly inclined with respect to a respective radial direction.

It goes without saying that in addition to the V-shaped and/or curved embodiments and the basically linear embodiments of the hair-entry slots 46, 146 and the cutting edges 64, 164 discussed herein, also hybrid embodiments are conceivable, i.e. slightly curved hair-entry slots and cutting edges. However, it is preferred that an apex (tip) of such a geometry points in the direction of the rotation. Hence, the frontal edge of the hair-entry slots may be concavely shaped, and the cutting edge of the rotary cutter may be convexly shaped.

FIG. 11 illustrates an enlarged partial top view of a shaving unit 124 comprising the guard cap 128 of FIG. 9 and the rotary cutter 130 of FIG. 10. It can be clearly seen that the frontal edge 148 at the hair-entry slots 146 are inclined with respect to the radial direction (refer to the radial ray 196 departing from the axis 126 at the center of the shaving unit 124).

Reference numeral 170 indicates a cutting portion along a long side extension of the frontal edges 148 of the hair-entry slots 146. The cutting portion 170 is an area where the hair-entry slot 146 and the cutter blade 162 contact one another and cooperate to cut hair therebetween.

The frontal edge 148 is arranged at an angle α (alpha) with respect to the radial direction 196. The cutting edge 164 of the cutter blade 162 is arranged at an angle β (beta) with respect to the radial direction 196. The angle α may also be referred to as slot angle. The angle β may also be referred to as inclination angle of the cutting edge 164.

It is apparent from FIG. 10 that the angle β is greater than the angle α. An angle difference between the angles α and β is indicated by an angle δ (delta) which may also be referred to as shearing angle.

Ranges and values for the slot angle α, the inclination angle β, and the shearing angle δ already have been discussed further above in connection with FIG. 8. Those ranges and values may also be applied to the embodiment illustrated in FIGS. 9 to 11.

Overall, the cutting edge 164 is more inclined (steeper) with respect to the radial direction 196 than the frontal edge 148.

Also the arrangement illustrated in FIG. 11 in more detail has the effect that it is more likely that hairs are cut at the current position. By contrast, it is less likely if not impossible that hairs are pushed towards the tips of the hair-entry slots 46 prior to the cutting action.

Both in FIG. 11 and in FIG. 8, a positive shearing angle δ is shown, which results in the angle of inclination β being greater than the slot angle α. However, in certain exemplary embodiments, a negative shearing angle δ may be present in both configurations, which results in the angle of inclination β being smaller than the slot angle α. Further, in certain exemplary embodiments, the shearing angle can be basically zero, which results in the angle of inclination β and the slot angle α having the same value.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A shaving unit comprising:

a rotary cutter comprising a plurality of cutter blades comprising cutting edges, the rotary cutter being arranged to rotate about a rotation axis in a direction of movement rotary cutter; and a guard cap comprising an annular shaving track surrounding the rotation axis for cooperation with the cutter blades, the annular shaving track being provided with hair-entry slots that, seen in the direction of movement, have a frontal edge and a rear edge, the frontal edge having a curved section;

wherein: the frontal edges of the hair-entry slots are, in a cutting portion along a long side extension of the hair-entry slots, inclined with respect to a radial direction relative to the rotation axis; the cutting portion is defined by a contact between the each of the hair entry slots and the cutter blade; a slot angle is defined as an angle of inclination of the frontal edges of the hair-entry slots with respect to the radial direction; the radial direction is defined by an imaginary line tangent to an apex of the curved section of the frontal edge; a shearing angle, defined as a difference between the slot angle and an angle of inclination of the cutting edges of the cutter blades with respect to the radial direction, is less than +/−20°; and the shearing angle is defined at an actual point where the frontal edges and the cutting edges cooperate, the slot angle being in a range from 35° to 60°.

2. The shaving unit as claimed in claim 1, wherein the slot angle is in a range from 35° to 45°.

3. The shaving unit as claimed in claim 1, wherein the shearing angle is less than +/−15°.

4. The shaving unit as claimed in claim 1, wherein the angle of inclination of the cutting edges of the cutter blades with respect to the radial direction is greater than 40°.

5. The shaving unit as claimed in claim 1, wherein the hair-entry slots have a substantially straight main extension.

6. The shaving unit as claimed in claim 5, wherein the cutter blades have a substantially straight main extension.

7. The shaving unit as claimed in claim 1, wherein the frontal edges of the hair-entry slots are curved in the radial direction relative to the rotation axis.

8. The shaving unit as claimed in claim 7, wherein the cutting edges of the cutter blades are curved in the radial direction relative to the rotation axis, and wherein the hair-entry slots and the cutter blades have the same curvature orientation.

9. The shaving unit as claimed in claim 1, wherein the hair-entry slots have a V-shaped main extension, and wherein tips of V-shaped hair-entry slots are front-oriented, seen in the direction of movement.

10. The shaving unit as claimed in claim 9, wherein the cutter blades have a V-shaped main extension and two cutting portions, and wherein tips of V-shaped cutter blades are front-oriented, seen in the direction of movement.

11. The shaving unit as claimed in claim 10, wherein at the hair-entry slots and the cutter blades two cutting portions are present, one of which being defined as a first leg of, respectively, the V-shaped hair-entry slots and the V-shaped cutter blades and another one being defined as a second leg of, respectively, the V-shaped hair-entry slots and the V-shaped cutter blades.

12. The shaving unit as claimed in claim 11, wherein the first and the second legs have opposite inclination angles with respect to the radial direction.

13. The shaving unit as claimed in claim 11, wherein an angle, which is enclosed by the cutting edges of the first leg and the second leg of the V-shaped cutter blades, is smaller than an angle which is enclosed by the frontal edges of the first leg and the second leg of the V-shaped hair-entry slots.

14. The shaving unit of claim 10, wherein the V-shaped hair-entry slots and the V-shaped cutter blades are parallel to one another.

15. A shaving head for a shaving appliance, the shaving head comprising two or more shaving units as claimed in claim 1 and a support member supporting the shaving units.

16. A shaving appliance comprising a housing, a shaving head as claimed in claim 15, and a drive unit to cause rotation of the rotary cutters of the shaving units of the shaving head.

17. The shaving unit as claimed in claim 1, wherein the shearing angle is less than +/−10°.

* * * * *